US010417844B2

(12) United States Patent
Ambrose et al.

(10) Patent No.: US 10,417,844 B2
(45) Date of Patent: Sep. 17, 2019

(54) ELECTRONIC LOGGING DEVICE EVENT GENERATOR

(71) Applicant: J. J. Keller & Associates, Inc., Neenah, WI (US)

(72) Inventors: James Allen Ambrose, McMinnville, OR (US); Jason Philip Goodrich, Fort Collins, CO (US)

(73) Assignee: J. J. KELLER & ASSOCIATES, INC., Neenah, WI (US)

( * ) Notice: Subject to any disclaimer, the term of this patent is extended or adjusted under 35 U.S.C. 154(b) by 152 days.

(21) Appl. No.: 15/462,552

(22) Filed: Mar. 17, 2017

(65) Prior Publication Data

US 2018/0268623 A1 Sep. 20, 2018

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01); *G07C 5/0808* (2013.01)

(58) Field of Classification Search
CPC ..... G07C 5/085; G07C 5/008; G07C 5/0808
See application file for complete search history.

(56) References Cited

U.S. PATENT DOCUMENTS 8,301,330 B2 10/2012 Nielsen
8,509,987 B2 8/2013 Resner
9,158,962 B1 * 10/2015 Nemat-Nasser ... G06K 9/00845
2007/0173993 A1 7/2007 Nielsen et al.
2012/0246039 A1 * 9/2012 Fain ..... G06Q 10/08 705/32
2014/0162219 A1 * 6/2014 Stankoulov ..... G09B 19/167 434/65
2015/0170428 A1 * 6/2015 Harter ..... G07C 5/008 701/31.5
2015/0178737 A1 6/2015 Simpson et al.
2016/0117871 A1 4/2016 McClellan et al.
2016/0133065 A1 5/2016 Baer et al.
2016/0293011 A1 * 10/2016 Erlich ..... H04L 51/38
2017/0221278 A1 * 8/2017 Harter ..... G07C 5/008
2018/0165145 A1 * 6/2018 Mielke ..... G06F 11/0745

* cited by examiner

*Primary Examiner* — Mary Cheung
(74) *Attorney, Agent, or Firm* — Michael Best & Friedrich LLP

(57) ABSTRACT

A driver logging device events generator. In example, the events generator includes an input port configured to receive telemetric data generated by a vehicle control module and sent from a vehicle diagnostic port; a positioning information source; and an electronic processor coupled to the input port and the positioning information source. The electronic processor is configured to receive telemetric data, location information, and timing data; process the telemetric data to extract a subset of data points; receive driver input from a mobile device; determine at least one event value based on the driver input, the location information, and the timing data; generate a logging device event from a pre-determined set of events based on the at least one event value, the event including an event type and an event code based on the driver input and the subset of data points; and send the event to the mobile device.

18 Claims, 9 Drawing Sheets

902 904 906

| TYPE CODE | EVENT CODE | DESCRIPTION |
|---|---|---|
| 1 | 1 | Driver's duty status changed to "Off-duty" |
| 1 | 2 | Driver's duty status changed to "Sleeper Berth" |
| 1 | 3 | Driver's duty status changed to "Driving" |
| 1 | 4 | Driver's duty status changed to "On-duty not driving" |
| 2 | 1 | Intermediate log with conventional location precision |
| 2 | 2 | Intermediate log with reduced location precision |
| 3 | 1 | Driver indicates "Authorized Personal Use of CMV" |
| 3 | 2 | Driver indicates "Yard Moves" |
| 3 | 0 | Driver indication for PC, YM and WT cleared |
| 4 | 1 | Driver's first certification of a daily record |
| 4 | N | Driver's n'th certification of a daily record (When re certification necessary)."n" is an integer between 1 and 9. If more then 9 certifications needed, use 9 for each new re-certification record. |
| 5 | 1 | Authenticated driver's ELD login activity |
| 5 | 2 | Authenticated driver's ELD logout activity |
| 6 | 1 | Engine power -up with conventional location precision |
| 6 | 2 | Engine power -up with reduced location precision |
| 6 | 3 | Engine shut down with conventional location precision |
| 6 | 4 | Engine shut-down with reduced location precision |
| 7 | 1 | An ELD malfunction logged |
| 7 | 2 | An ELD malfunction cleared |
| 7 | 3 | A data diagnostic event logged |
| 7 | 4 | A data diagnostic event cleared |

FIG. 9

ELECTRONIC LOGGING DEVICE EVENT GENERATOR

FIELD

Embodiments relate to electronic logging devices (ELDs) used in commercial and other vehicles to monitor the activities of drivers. More particularly, embodiments relate to an electronic logging device (ELD) event generator (EEG).

BACKGROUND

Drivers of commercial motor vehicles ("CMV's") are required to comply with certain regulations governing such vehicles. In the United States of America, the U.S. Department of Transportation, Federal Motor Carrier Safety Administration ("FMCSA") promulgates various regulations including, for example, hours-of-service regulations (which limit the number of hours a driver may drive a CMV). Traditionally, drivers and operators of CMVs maintained paper logs to facilitate compliance with hours-of-service and other regulations. More recently, electronic logging devices (ELDs) have replaced traditional systems and, in some cases have been designed to provide functions and features not available in prior systems.

SUMMARY

Typically, ELDs are specialized electronic devices that are mounted in vehicles. The vehicle-mounted electronic devices are sometimes referred to as "base units." In some cases, ELDs may be designed to communicate with another device, for example a smart telephone or similar portable device that provides a display and a user interface through which a driver may provide information. An ELD base unit and portable device may be referred to as a "driver logging system." The portable device, the ELD, or both include software or other components designed to determine and display driver compliance-related events and information. For example, hours of service information may be determined by the portable device based on information received from the ELD.

Many ELDs obtain information regarding the performance and activity of the CMV, which is ultimately required to determine and evaluate driver compliance with various driver regulations. One way in which information regarding the operation of a vehicle may be obtained is through an on-board diagnostic ("OBD") port. An OBD port may be connected to a vehicle information bus, a vehicle control module (VCM), an engine control module (ECM), a vehicle diagnostics system, or a combination of these components. An interconnection between the ELD and the OBD port allows the ELD to communicate with the VCM of the vehicle. In many cases, the software and components of an ELD are designed to operate with a specific vehicle (for example, interact with and understand data from a specific type of OBD port). As a consequence, multiple versions of ELDs or software used in driver logging systems may be required when it is desired to interact with different types of OBD ports that may be present in different vehicles.

Embodiments provide an electronic logging device (ELD) event generator (EEG) that is configured to process OBD data received from a variety of vehicle bus types in order to generate one of a plurality of driver logging device events or ELD events. The driver logging device events are then provided to the ELD or to the driver logging system for use in generating driver logs, determining driver compliance, and generating compliance information.

One embodiment provides a driver logging device events generator that includes an input port configured to receive telemetric data generated by a vehicle control module and sent from a vehicle diagnostic port. The driver logging device events generator also includes a positioning information source; an electronic processor coupled to the input port and the positioning information source and configured to receive telemetric data, location information, and timing-related information. The electronic processor is configured to process the telemetric data to extract a subset of data points; receive driver input from a mobile device; determine at least one event value based on the driver input, the location information, and the timing-related information; and generate a logging device event from a predetermined set of logging device events based on the at least one event value. The logging device event includes an event type and an event code based on the driver input and the subset of data points. The electronic processor is also configured to send the logging device event to the mobile device.

Another embodiment provides a method for generating a logging device event through an electronic processor of a driver logging device events generator. The method includes receiving telemetric data, location information, and timing-related information; and processing the telemetric data to extract a subset of data points; receiving driver input from a mobile device. The method also includes determining at least one event value based on the driver input, the location information, and the timing-related information. The method also includes generating a logging device event from a pre-determined set of logging device events based on the at least one event value. The event includes an event type and an event code based on the driver input and the subset of data points. The method also includes sending the logging device event to a mobile device.

Other aspects of the various embodiments will become apparent by consideration of the detailed description and accompanying drawings.

BRIEF DESCRIPTION OF THE DRAWINGS

FIG. 9 illustrates a table detailing the event codes possible for each of the logging device events of FIGS. 2-8 according to one embodiment.

DETAILED DESCRIPTION

Before any embodiments are explained in detail, it is to be understood that the embodiments are not limited in their application to the details of construction and the arrangement of components set forth in the following description or illustrated in the following drawings. Various embodiments may be practiced or carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. The term "predetermined" means specified prior to an event. Also, electronic communications and notifications may be performed using any known means including direct connections (for example, wired or optical), wireless connections, or other communication.

It should also be noted that a plurality of hardware and software based devices, as well as a plurality of different structural components may be utilized to implement embodiments. In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects may be implemented in software (for example, stored on non-transitory computer-readable medium) executable by one or more processors. As such, it should be noted that a plurality of hardware and software based devices, as well as a plurality of different structural components may be utilized to implement various embodiments.

Figure 1:
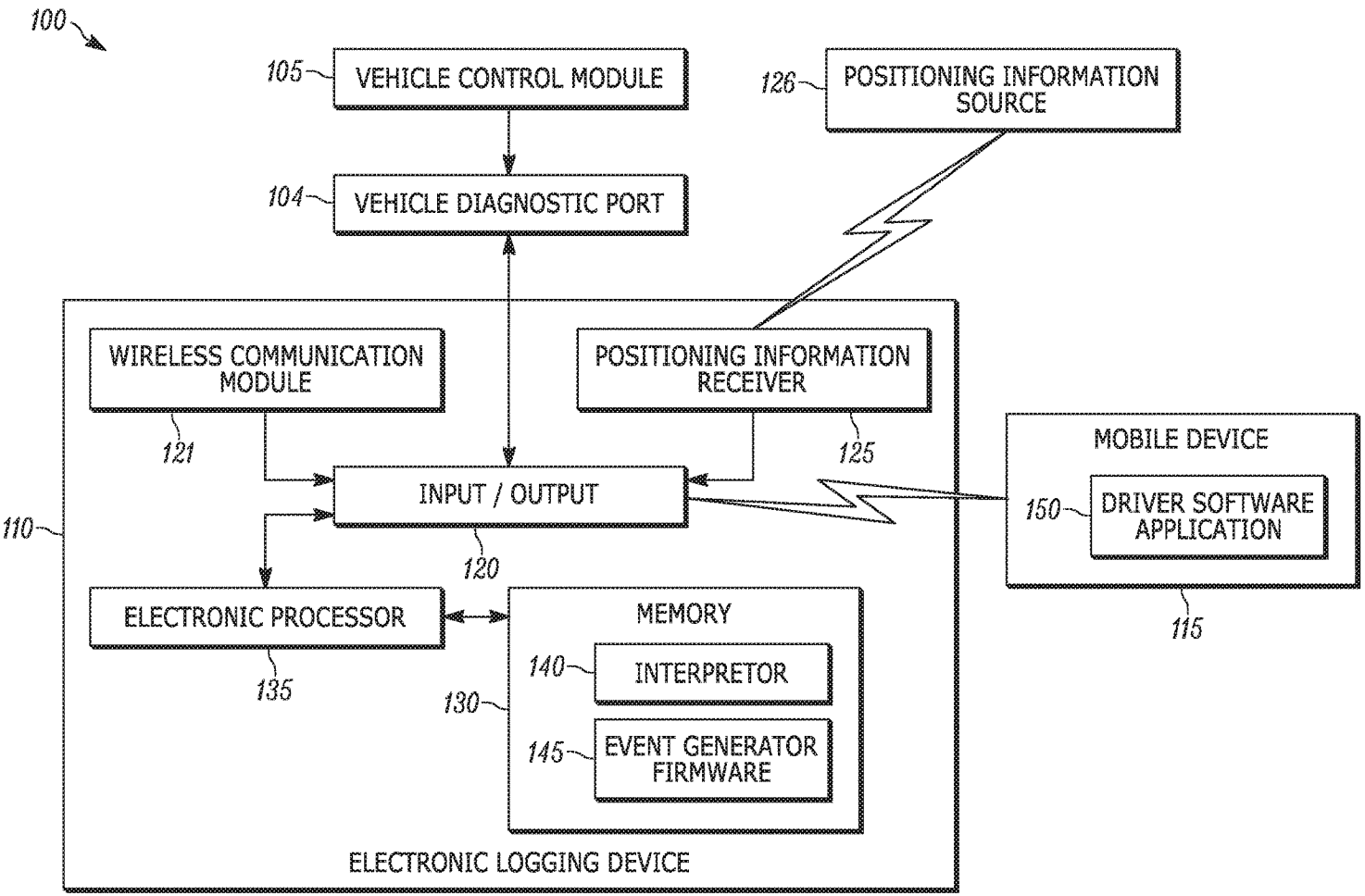
FIG. 1 schematically illustrates a logging device event generator system in electrical communication with a VCM of a vehicle according to one embodiment.

FIG. 1 schematically illustrates a driver logging device events generator system 100 in electrical communication with a VCM 105 of a vehicle. In the example illustrated in FIG. 1, the driver logging device events generator system 100 includes an ELD 110 and a mobile device 115. The ELD 110 includes an input/output port 120 and a memory 130 coupled to an electronic processor 135. The input/output port 120 is connected to a vehicle diagnostic port 104, a wireless communication module 121, and a positioning information receiver 125. The vehicle diagnostic port 104 is communicatively connected to the VCM 105. The VCM 105 generates and sends telemetric information to the input/output port 120 through the vehicle diagnostic port 104. The wireless communication interface may be configured to communicate with the mobile device 115 and/or other mobile devices in accordance with a wireless communication protocol, for example, Bluetooth, Wi-Fi, and other protocols. The positioning information receiver 125 receives positioning and time information from a positioning information source 126 outside the ELD 110. In some embodiments, the positioning information receiver 125 may be a global positioning system (GPS) receiver and the positioning information source 126 is a GPS satellite. From this information, the electronic processor 135 is able to calculate information relative to the vehicle's location and time information. The electronic processor 135 may include a microprocessor, an application specific integrated circuit, or other suitable electronic device. For example, the electronic processor 135 may include a microprocessor configured to execute instructions stored in one or more non-transitory computer-readable storage mediums. One set of instructions stored in one or more non-transitory computer-readable storage mediums, for example the memory 130, may include an interpreter 140.

An electronic logging device (ELD) event generator firmware or other software 145 is stored in one or more non-transitory computer-readable storage mediums and is executed by the electronic processor 135 of the ELD 110. The ELD event generator (EEG) software 145 is a program of the driver logging device events generator system 100 providing instructions to generate one of a pre-determined set of logging device events based on data from the VCM 105 and mobile device 115. The EEG software 145 includes instructions to communicate with a driver software application 150 on the mobile device 115. In some cases, the driver application software 150 may be offline when a logging device event occurs. Accordingly, in some embodiments, the EEG software 145 includes instructions, which when executed, cause the electronic processor 135 to record the event data received from the ELD 110 in the memory 130.

As noted, the mobile device 115 includes the driver software application 150. The driver software application 150 transfers data to and receives and processes data from the ELD 110. The driver logging device events generator system 100 utilizes the hardware of the ELD 110 and mobile device 115 to determine and generate one of several logging device events based on data received from the vehicle control module 105 and the mobile device 115. The data the driver logging device events generator system 100 receives is used to determine one of a set of pre-determined logging device events.

The driver logging device events generator system 100 receives data from the vehicle control module 105 of the vehicle. The ELD 110 requests, receives, and processes the data from the vehicle control module 105. The data received from the vehicle control module 105 includes, for example, telemetric information, location information, timing-related information, or combinations of the same. Specific information may include the vehicle identifier (VIN), UTC (Coordinated Universal Time) time and UTC date (from the global positioning receiver), latitude, longitude, odometer readings, road or vehicle speed, engine revolutions per minute (RPM), engine hours, and ignition status. The ELD 110 executes the event generator software and processes the data received from the vehicle control module 105 and extracts certain data points necessary to determine which logging device event to generate.

Data from a human interface (for example, a graphical user interface) or software application is also used to determine which of the logging device events to generate. A driver or a team of drivers use the interface or application to provide information about the driver and his/her trucking or vehicle company. The data includes a driver identifier, motor carrier information, record originator, shipping document number, and event comment/annotation.

Data may also be calculated by the ELD 110 based off the data received over the duration of the driving time period or trip. In one example, this data includes odometer information, trip engine hours, distance since last valid global positioning coordinates, event sequence ID, event record status, event record origin, and ELD malfunction/data diagnostic event.

From the data received, the driver software application 150 (while the mobile device 115 is connected to the ELD 110) extracts a subset of data points from the telemetric data. The ELD 110 may also extract a subset of data points from the telemetric data. The ELD 110 or the driver software application 150 (whichever performs the extraction of the subset of data points for the event) determines data points to describe the logging device event generated, for example Event Record Status Event Record Origin Driver's Location Description The event record status provides an indication of whether a record was edited or manually entered. A record status may indicate that the status record is original (was originally from the ELD 110), or if the record was inactively changed (edited after event by a user). The event record status may also provide an indication of an inactive change request (an accepted edit of saved record by a user). The record status may also provide an indication of an inactive change reject (an edit of a saved record by a user was declined). In one example, a numeric indicator "4" is used to indicate a change reject. The event record origin indicates the source of the record. The record may have been automatically generated by the ELD or edited or entered by the driver. The record may have also have been an edit requested by an authenticated user other than the driver. The record may also have been assumed to be from an unidentified driver profile. The driver's location description indicates the approximate location of the user and is determined through reverse geocoding.

Figure 2:
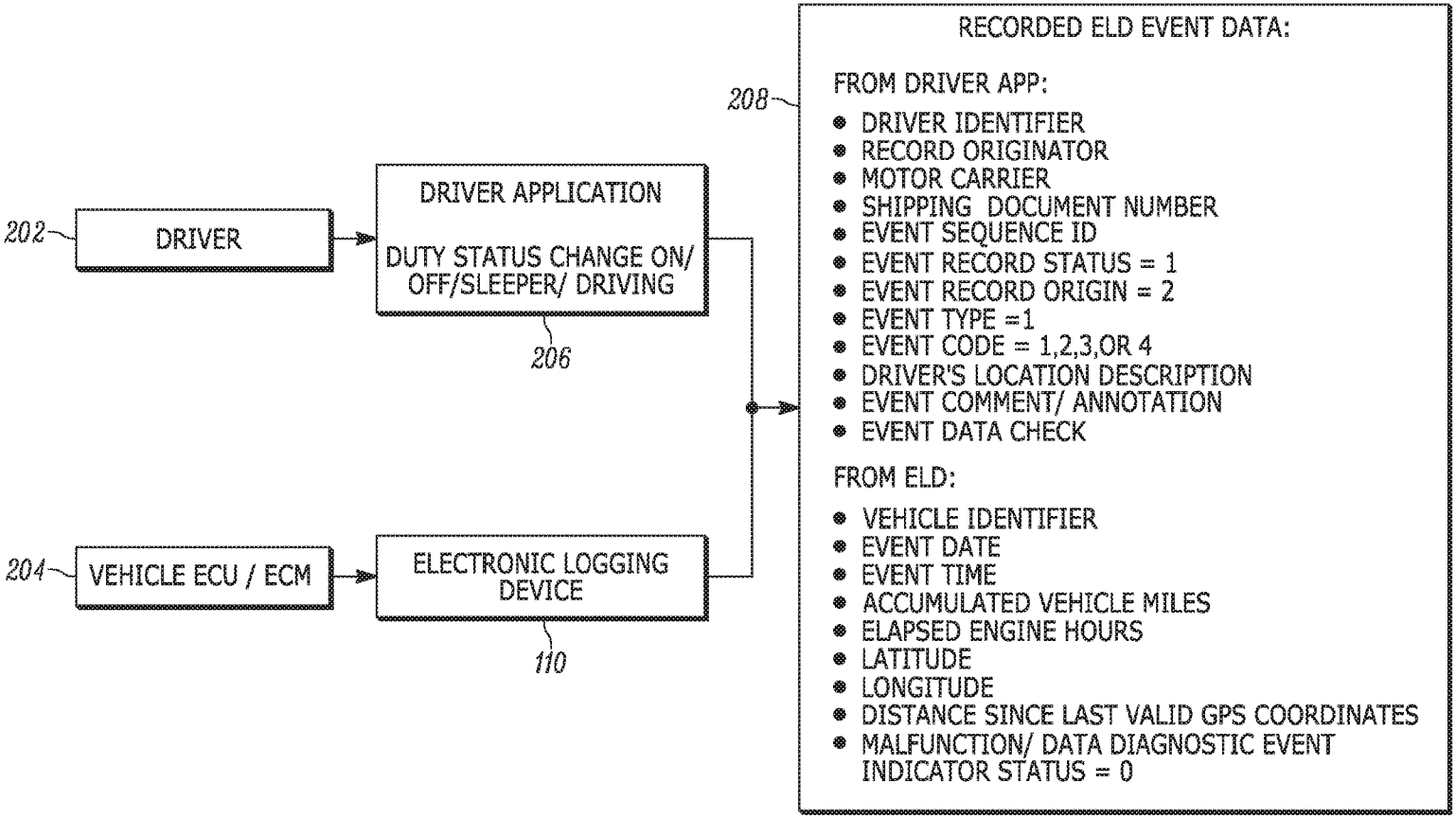
FIG. 2 schematically illustrates an information flow diagram of a first ELD event according to one embodiment.

FIGS. 2-8 illustrate information flow diagrams of a plurality of logging device events generated by the driver logging device events generator system 100. In one embodiment, seven logging device events are generated. The seven logging device events are generated based on data received from a driver 202 through the driver software application 150 and vehicle data received by the ELD 110 from the VCM 204. The EEG evaluates data (from the vehicle control module 204, ELD 110, and the driver software application 150) to generate a logging device event and associated data values. The seven logging device events generated by the driver logging device events generator system 100 and are shown in the corresponding figures:

ELD Event 1—Driver Changes Duty Status (FIG. 2)

Figure 3:
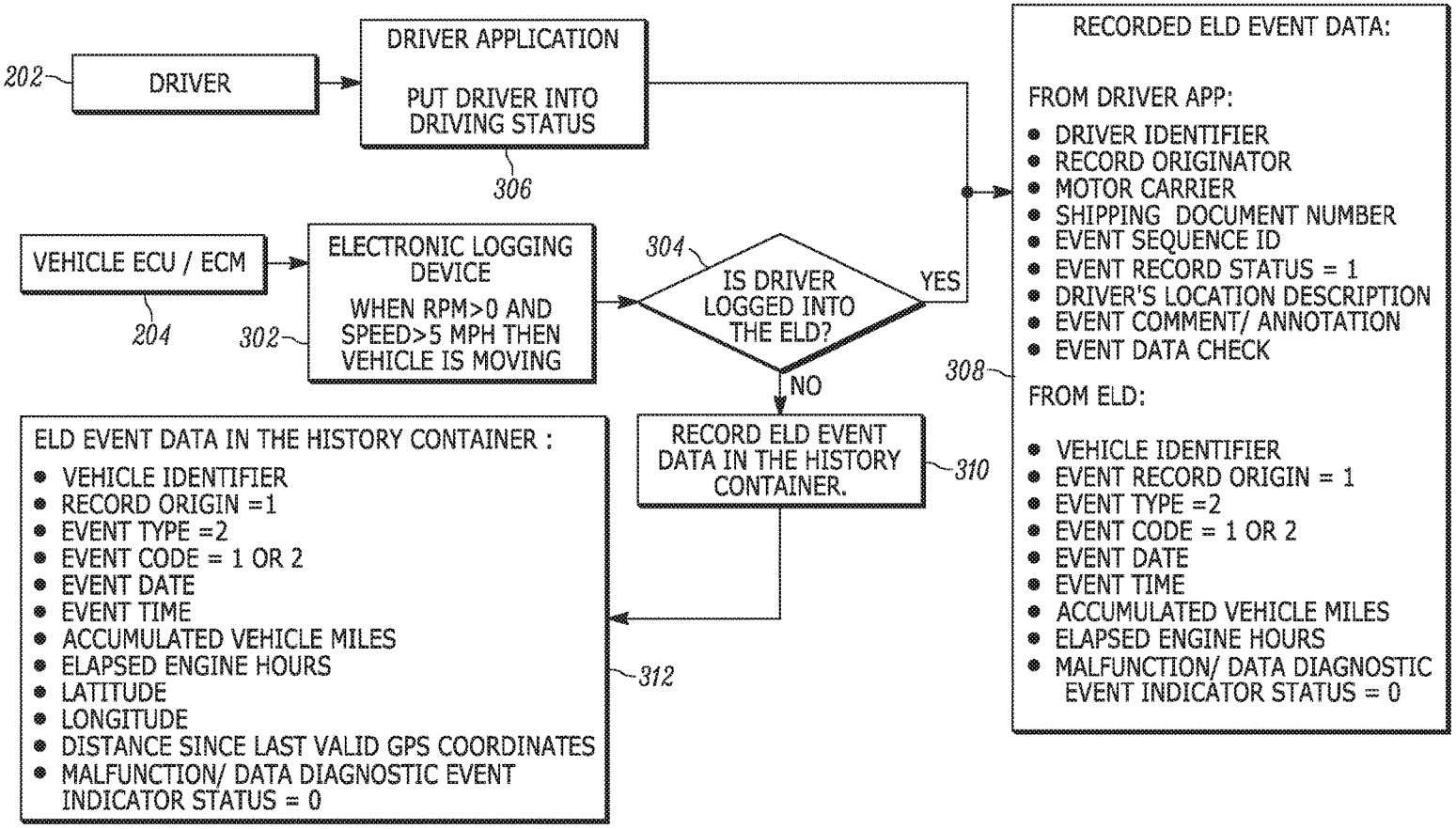
FIG. 3 schematically illustrates an information flow diagram of a second ELD event according to one embodiment.

ELD Event 2—Intermediate Recording (FIG. 3)

Figure 4:
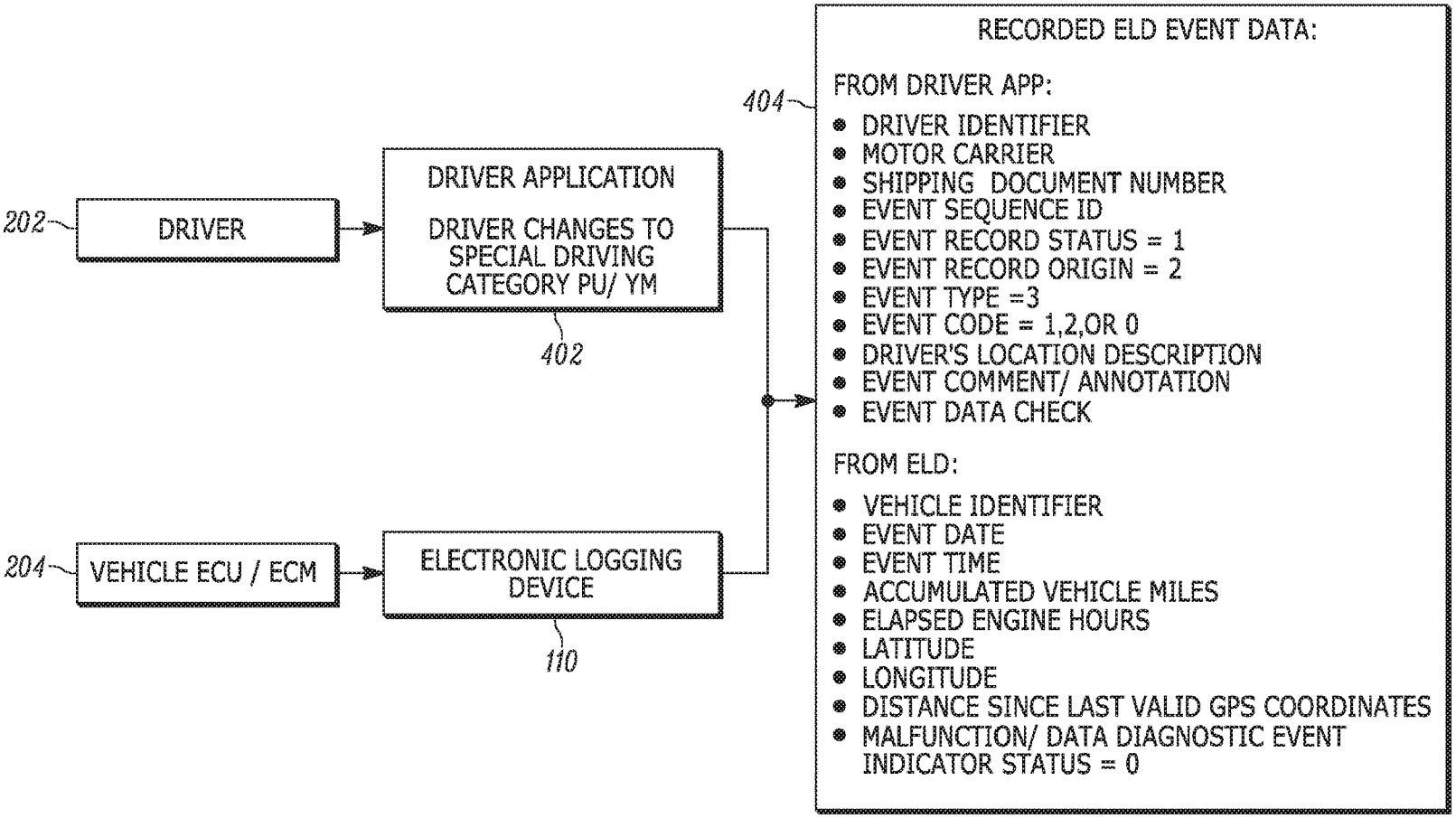
FIG. 4 schematically illustrates an information flow diagram of a third ELD event according to one embodiment.

ELD Event 3—Driver Selects a Special Driving Category (FIG. 4)

Figure 5:
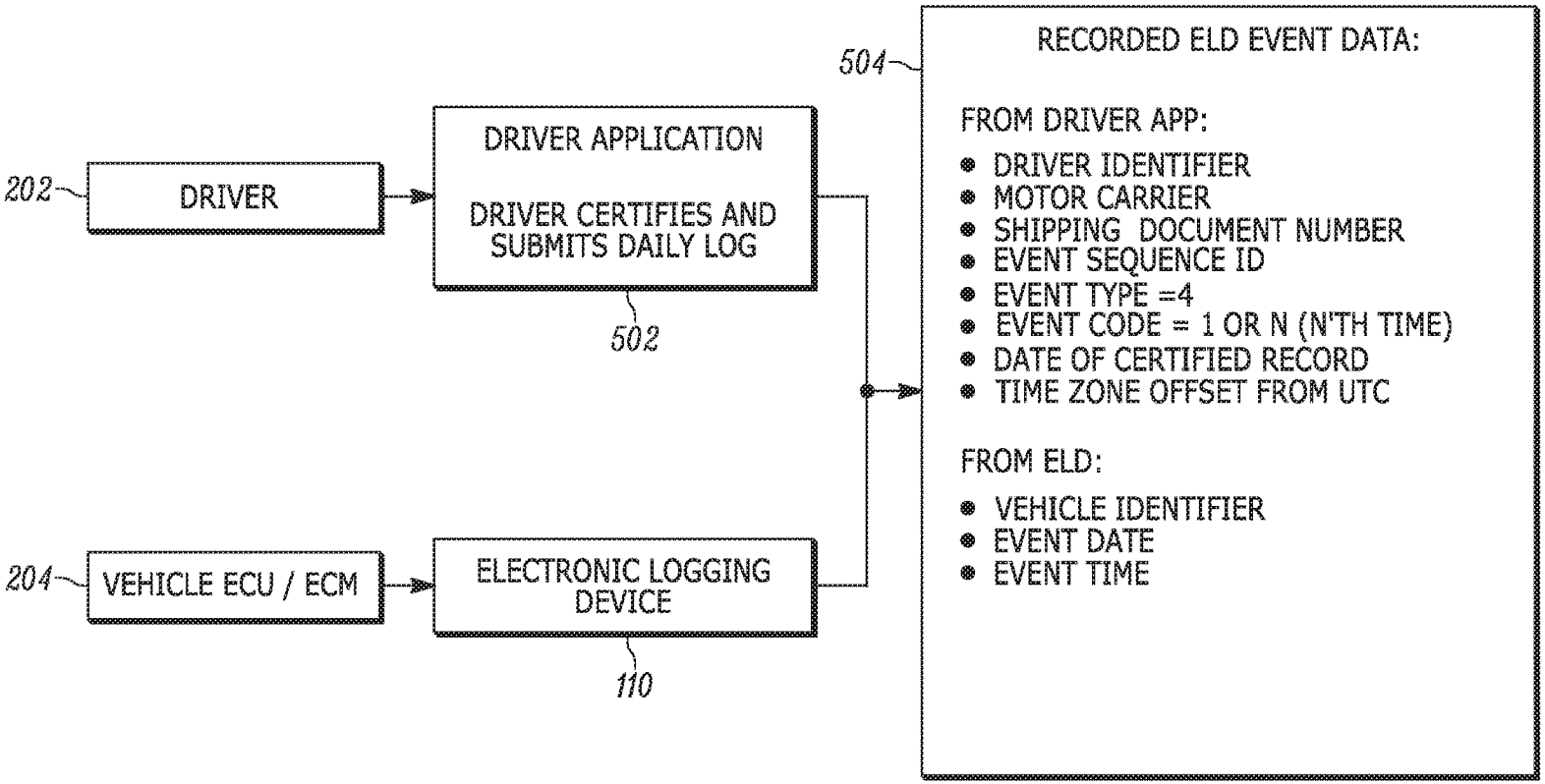
FIG. 5 schematically illustrates an information flow diagram of a fourth ELD event according to one embodiment.

ELD Event 4—Driver Certifies Daily Log (FIG. 5)

Figure 6:
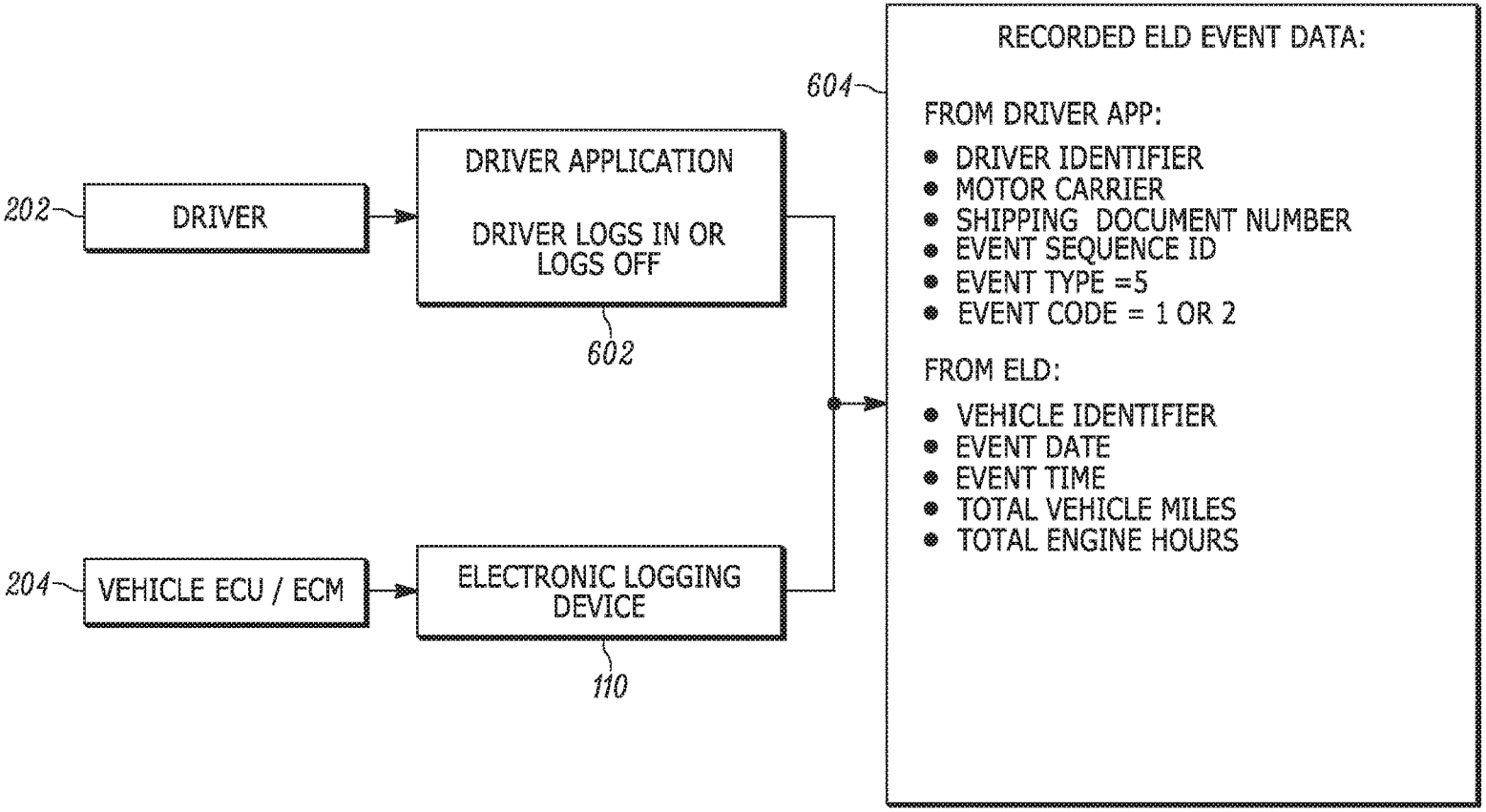
FIG. 6 schematically illustrates an information flow diagram of a fifth ELD event according to one embodiment.

ELD Event 5—Driver Logs In/Logs Off (FIG. 6)

Figure 7:
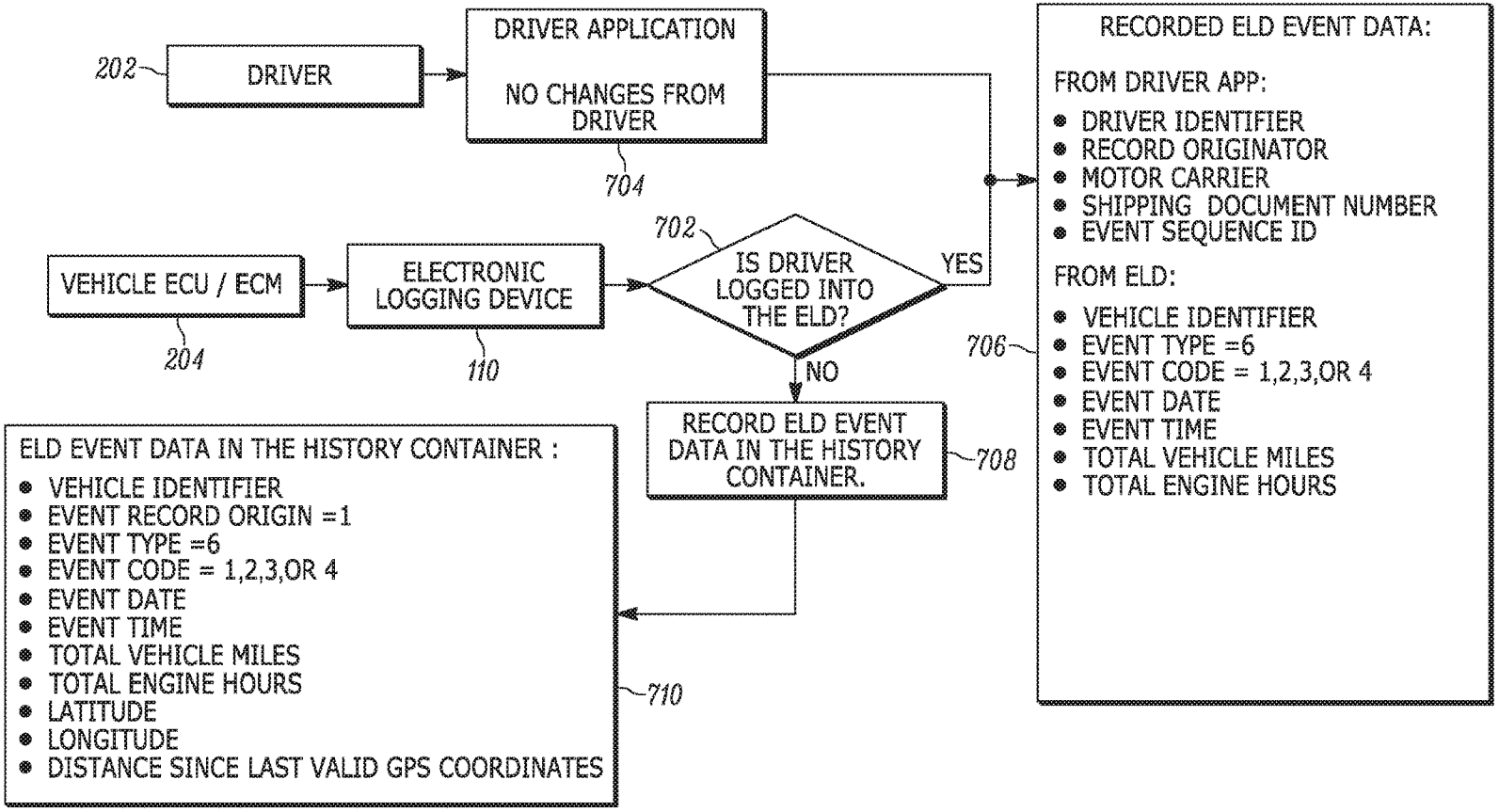
FIG. 7 schematically illustrates an information flow diagram of a sixth ELD event according to one embodiment.

ELD Event 6—Vehicle's Engine Power On/Off (FIG. 7)

Figure 8:
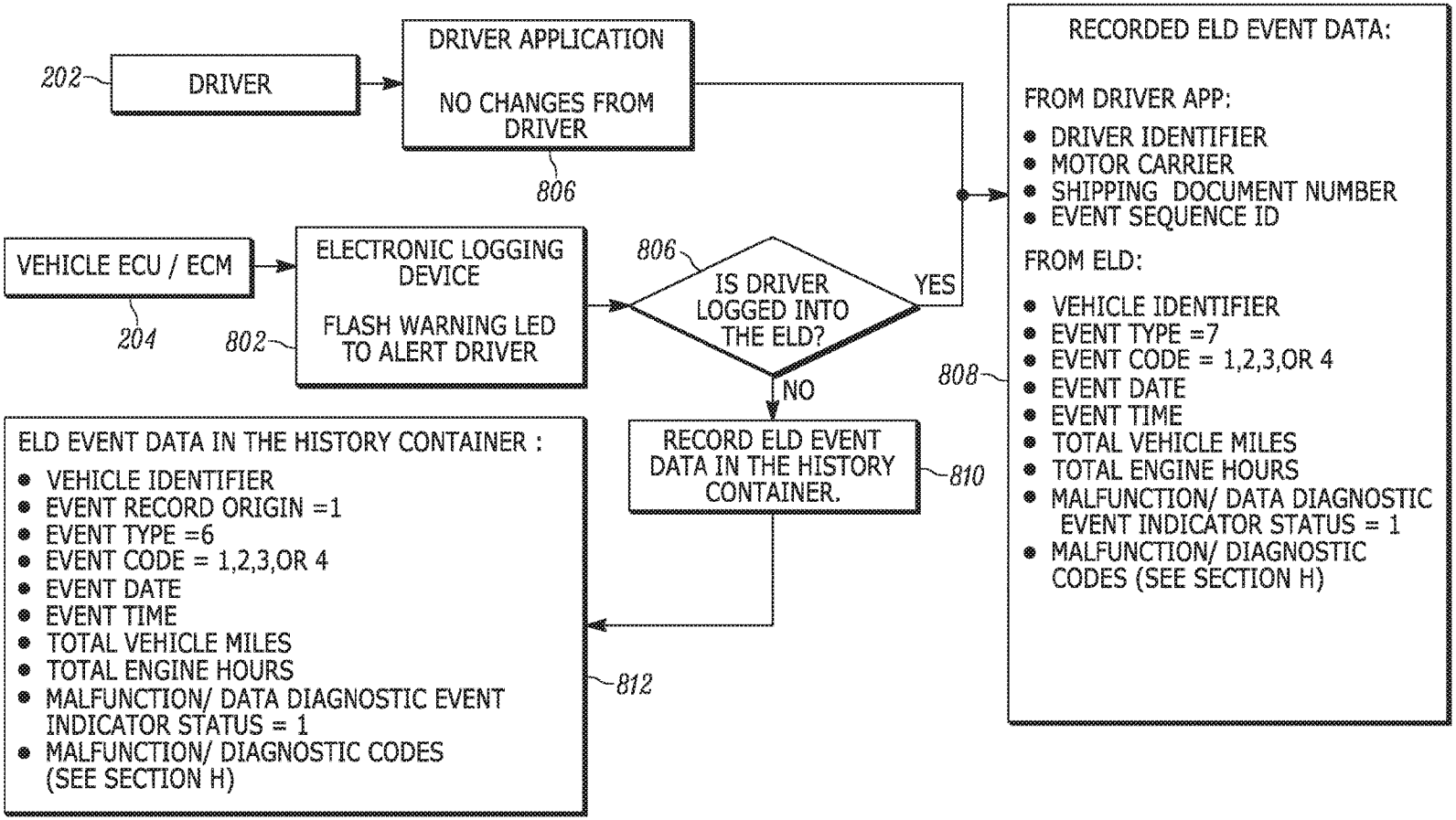
FIG. 8 schematically illustrates an information flow diagram of a seventh ELD event according to one embodiment.

ELD Event 7—Malfunction or Data Diagnostic (FIG. 8)

During driver input events, the EEG requests the next Event Sequence ID number from the ELD 110. The EEG then calculates the Event Data Checksum and attaches the Event Data Checksum to the end of the event record. Preferably, the EEG is hardware agnostic. This allows the EEG to be deployed on multiple ELDs or ELDs and associated driver software applications.

FIG. 2 is an information flow diagram of a process that generates the ELD Event 1 and information that is recorded. At the ELD block 202, a driver enters information through the driver software application 150. At block 206, the driver of the vehicle changes the driver duty status to one of four statuses (On-duty, Off-duty, Sleeper, Driving) through the driver software application 150. The driver software application 150 collects and generates data that is recorded in the ELD Event 1. The driver software application 150 requests VCM 204 data from the ELD 110. The ELD 110 receives data from the VCM 204 and forwards the data to the driver software application 150 to be recorded. Block 208 illustrates the types of data points recorded from the ELD 110 and the driver software application 150. For all events, the driver identifier, the record originator, the motor carrier, the shipping document number, and the event comment/annotation are recorded in the ELD event.

FIG. 3 is an information flow diagram of a process that generates the ELD Event 2 and recorded information. At block 302, the ELD 110 determines whether the vehicle is in motion by determining if the vehicle speed is greater than or equal to a predetermined threshold. At block 302 the ELD 110 also determines if the driver is logged into the ELD 110 (block 304). When the driver is logged into the ELD 110 (block 306), the driver software application 150 changes the driver duty status to "driving." When no change in driver duty status is entered into the ELD 110 or driver software application 150 and no other intermediate status is recorded in an hour, the ELD Event 2 data listed in block 308 is recorded. When the driver is not logged into the ELD 110 and no change in driver duty status is entered into the ELD 110 or driver software application 150 and no other intermediate status is recorded in an hour (block 310), ELD Event 2 data from the ELD 110 is stored in a history container inside the memory 130. The ELD Event 2 data stored is listed in block 312.

FIG. 4 is an information flow diagram of a process that generates ELD Event 3 and recorded information. The ELD Event 3 is generated at block 402 when the driver 202 is logged into the ELD 110 and selects a special driving category (personal use ("PU"), personal conveyance "PC", or yard moves "YM")) through the driver software application 150. Block 404 lists the types of data points recorded from the ELD 110 and the driver software application 150.

FIG. 5 is an information flow diagram of a process that generates the ELD Event 4 and recorded information. The ELD Event 4 is generated at block 502 when the driver is logged into the ELD 110 and sends a daily log submission or a certification of a daily log through the driver software application 150. Block 504 lists the types of data points recorded from the ELD 110 and the driver software application 150.

FIG. 6 is an information flow diagram of a process that generates the ELD Event 5 and recorded information. The ELD Event 5 is generated at block 602 when the driver is logged into the ELD 110 and submits a log-in or log-off command through the driver software application 150. Block 604 lists the types of data points recorded from the ELD 110 and the driver software application 150.

FIG. 7 is an information flow diagram of a process that generates the ELD Event 6 and recorded information. At block 702, the ELD 110 determines from the VCM 204 that the engine of the vehicle has been powered on or off and if the driver is logged into the ELD 110. When the driver is logged into the ELD 110 at block 704 the driver software application 150 determines if there have been any changes entered into the driver software application 150, such as a change in driver duty status or a log in or log off. When no change in driver duty status is entered into the ELD 110 or driver software application 150, the ELD Event 6 data listed in block 706 is recorded. When the driver is not logged into the ELD 110 and no changes are entered into the ELD 110 or driver software application 150 and no other intermediate status is recorded in an hour, at block 708, ELD Event 6 data from the ELD 110 is stored in a history container inside the memory 130. The ELD Event 6 data stored is listed in block 710.

FIG. 8 is an information flow diagram of a process that generates the ELD Event 7 and recorded information. At block 802, the ELD 110 determines from either the VCM 204 or itself the occurrence of a malfunction or a data diagnostic event (explained in further detail below) and uses a visual indication (for example, flashing a warning light of the ELD or issuing a notification on the driver software application 150) to notify the user of the event. At block 806 the ELD 110 determines if the driver 202 is logged into the ELD 110. When the driver 202 is logged into the ELD 110 (block 806) the driver software application 150 determines if there have been any changes entered into the driver software application 150, for example a change in driver duty status or log in or log off. When no changes are entered into the ELD 110 or driver software application 150, the ELD Event 7 data listed in block 808 is recorded. When the driver is not logged into the ELD 110, at block 810, ELD Event 7 data from the ELD 110 is stored in the history container inside the memory 130. The ELD Event 7 data stored is listed in block 812.

The malfunction and diagnostic codes in the ELD event 7 are produced by the driver logging device events generator system 100, either from the ELD 110 or the mobile device 115 (running the driver software application 150). The malfunction or data diagnostic event generates a code upon detecting either a malfunction or data diagnostic.

When a malfunction is detected, at least one visual indication, for example a light emitting diode (LED) on the ELD 110 or a message or signal on the mobile device 115 by the driver software application 150, is output. In some embodiments, the visual indicator is provided not associated with any particular user. As a consequence, the visual indicator is output without any restriction related to a particular user. A malfunction event is generated for example in the following cases:

Power Compliance
Engine Synchronization
Timing Compliance
Positioning Compliance
Data Recording Compliance
Data Transfer Compliance A power compliance malfunction event is generated when the EEG detects the in-motion driving time is under a predetermined amount of time (for example, 30 minutes) over a predetermined period (for example 24 hours) for all driver profiles. An engine synchronization compliance malfunction event is generated when the connectivity of any required data sources is lost for more than a predetermined time (for example 30 minutes) during a predetermined period (for example 24 hours). A timing compliance malfunction event is generated when the ELD 110 cannot meet a requirement of periodical cross-checking with respect to an accurate external UTC source. A positioning compliance malfunction event is flagged when the ELD 110 cannot acquire a valid position measurement within a predetermined number of miles (for example, five miles) of the vehicle's movement and when the elapsed time exceeds a predetermined period (for example, 60 minutes) over a predetermined period (for example, 24 hours). A data recording compliance malfunction event is triggered when the ELD 110 is unable to record or forward required events or retrieve recorded logs. Upon a data transfer data diagnostic event (described below), the ELD 110 must update its monitoring function periodically, for example once every 24 hours. A data transfer compliance malfunction event is triggered when the ELD 110 remains in an unconfirmed data transfer mode following an update or check of its monitoring function. In some embodiments, a data transfer malfunction is triggered if the ELD 110 remains in an unconfirmed data transfer mode following three consecutive monitoring checks. Other malfunction events generated may relate to the functionality of the ELD 110 via a self-diagnostic program and/or mechanism provided by the manufacturer of the ELD 110.

In the case of the detection of a data diagnostic, at least one visual indicator is triggered. For example, a message or signal is displayed on the mobile device 115 by driver software application 150. In one embodiment, the message or signal is only provided to an authenticated driver. A data diagnostic event is triggered for example in the following cases:

Power Data Diagnostic
Engine Synchronization Data Diagnostic
Missing Required Data Element Data Diagnostic
Data Transfer Data Diagnostic
Unidentified Driving Records Data Diagnostic A power data diagnostic event occurs when data from the VCM 105 is monitored and a data diagnostic is recoded at the time of detection. An engine synchronization data diagnostic event occurs when the ELD 110 is unable to acquire updated values for the ELD 110 parameters required for records within a predetermined amount of time, for example, within five seconds of the need. A missing required data element data diagnostic event occurs when at least one element of the ELD 110 record event information is missing. Some data elements differ depending on the event type. A data transfer data diagnostic is generated when the data transfer mechanism fails to confirm that it is operating correctly (recorded as an unconfirmed data transfer mode). An unidentified driving records data diagnostic is generated when the ELD 110 has recorded a predetermined amount of driving, for example 30 minutes, of driving) within a predetermined time period, for example a 24 hour period, belonging to an unidentified driving profile. The unidentified driving records data diagnostic is cleared once the driving time logged under the unidentified user profile for the current period and the previous seven days drops to 15 minutes or less). Other data diagnostic events may be generated by the ELD 110 depending upon the design and preferences provided by the manufacturer of the device.

As previously mentioned, the driver software application 150 generates, according to the data received, an event record status, an event record origin, and a driver's location description. The event record status and event record origin each have four possible values. The event record status may have a value (1) if active, (2) if an inactive change, (3) if an inactive change is requested, and (4) if an inactive change is rejected. The event record origin may have a value (1) if the event was automatically recorded by the ELD 110, (2) when the record was edited or entered by the driver, (3) when the record was an edit requested by an authenticated user other than the driver, and (4) when it is assumed to be from an unidentified driver profile.

A malfunction/data diagnostic event indicator status is triggered when at least one active malfunction is determined.

FIG. 9 is a table illustrating the possible flag values in each of the seven logging device events generated by the EEG. A type code 902 is an event that indicates which of the seven logging device events the logging device event is. For example, if the type code 902 has a value of "1", the event is ELD event 1, where the driver changes the driver duty status.

An event code 904 is a value relating to the specific event and provides further information about the event. For example, the event code 904 for ELD event 1 indicates which of the four driver duty statuses the drive has changed to. The event code 904 may be an integer value between 0-9. However, not all values are possible for certain events. For example, only an integer value between 1 and 4 is possible for the ELD event 1 while only a value of 1 or 2 is possible for the ELD event 2. A description 906 is provided to give an explanation of the meaning of the corresponding event code 904.

Various features and advantages of certain embodiments are set forth in the following claims.

What is claimed is:

1. A driver logging device events generator comprising:

an input port configured to receive telemetric data generated by a vehicle control module and sent from a vehicle diagnostic port;

a positioning information source;

an electronic processor coupled to the input port and the positioning information source and configured to receive telemetric data, location information, and timing-related information;

process the telemetric data to extract a subset of data points;

receive driver input from a mobile device, the driver input including a driver duty status change;

determine at least one event value based on the driver input, the location information, and the timing-related information;

generate at least one of a logging device event from a predetermined set of logging device events based on the at least one event value, the logging device event including an event type and an event code based on the driver input and the subset of data points, the at least one of the logging device event including a first logging device event being one selected from a group consisting of on-duty, off-duty, sleeper, and driving; and send the at least one of the logging device event to the mobile device.

2. The driver logging device events generator as claimed in claim 1, wherein the telemetric data includes vehicle speed, and wherein the electronic processor is configured to determine whether the speed is greater than or equal to a predetermined threshold, and to generate a second logging device event when the speed is greater than or equal to the predetermined threshold.

3. The driver logging device events generator as claimed in claim 2, wherein the electronic processor is further configured to determine, when the speed is greater than or equal to the predetermined threshold, if a change in the driver duty status was provided within a predetermined time period.

4. The driver logging device events generator as claimed in claim 3, wherein the electronic processor is configured to record the logging device event in a history container when a driver identifier is not provided.

5. The driver logging device events generator as claimed in claim 4, wherein the driver input includes a driving category selected from the group consisting of personal use and yard use.

6. The driving logging device events generator as claimed in claim 5, wherein the driver input includes a certification and submission of a daily log.

7. The driving logging device events generator as claimed in claim 6, wherein the driver input includes one selected from the group consisting of a log-off command and log-in command and the driver identifier.

8. The driving logging device events generator as claimed in claim 7, wherein the electronic processor is further configured to generate the at least one event value based on whether an engine of the vehicle control module is on or off when the driver input includes the log-off command.

9. The driving logging device events generator as claimed in claim 8, wherein the electronic processor is further configured to indicate a warning when a malfunction of the driver logging device event generator is detected.

10. A method for generating a logging device event through an electronic processor of a driver logging device events generator, the method comprising:

receiving telemetric data, location information, and timing-related information;

processing the telemetric data to extract a subset of data points;

receiving driver input from a mobile device, the driver input including a driver duty status change;

determining at least one event value based on the driver input, the location information, and the timing-related information;

generating at least one of a logging device event from a pre-determined set of logging device events based on the at least one event value, the logging device event including an event type and an event code based on the driver input and the subset of data points, the at least one of the logging device event including a first logging device event being one selected from a group consisting of on-duty, off-duty, sleeper, and driving; and sending the at least one of the logging device event to a mobile device.

11. The method as claimed in claim 10 wherein the telemetric data includes vehicle speed, and wherein the method further includes determining whether the speed is greater than or equal to a predetermined threshold, and generating the logging device event when the speed is greater than or equal to the predetermined threshold.

12. The method as claimed in claim 11, wherein the method further includes determine, when the speed is greater than or equal to the predetermined threshold, if a change in the driver duty status was provided within a predetermined time period.

13. The method as claimed in claim 12, wherein the method further includes recording the logging device event in a history container when a driver identifier is not provided.

14. The method as claimed in claim 13, wherein the driver input includes a driving category selected from the group consisting of personal use and yard use.

15. The method as claimed in claim 14, wherein the driver input includes a certification and a submission of a daily log.

16. The method as claimed in claim 15, wherein the driver input includes one selected from the group consisting of a log-off command and log-in command and the driver identifier.

17. The method as claimed in claim 16, wherein the method further includes generating the at least one event value based on whether an engine of the vehicle control module is on or off when the driver input includes the log-off command.

18. The method as claimed in claim 17, wherein the method further includes indicating a warning when a malfunction of the driver logging device event generator is detected.

* * * * *